US007128122B2

(12) United States Patent
Lin

(10) Patent No.: US 7,128,122 B2
(45) Date of Patent: Oct. 31, 2006

(54) VENETIAN BLIND HAVING A MOTORIZED DRIVE MECHANISM

(76) Inventor: Ker-Min Lin, 58, Ma Yuan West St., Taichung (TW)

( * ) Notice: Subject to any disclaimer, the term of this patent is extended or adjusted under 35 U.S.C. 154(b) by 133 days.

(21) Appl. No.: 10/800,187

(22) Filed: Mar. 10, 2004

(65) Prior Publication Data

US 2005/0199350 A1 Sep. 15, 2005

(51) Int. Cl.
*E06B 9/32* (2006.01)

(52) U.S. Cl. ..... 160/168.1 P; 160/170

(58) Field of Classification Search ..... 160/168.1 P, 160/84.02, 310, 23.1
See application file for complete search history.

(56) References Cited

U.S. PATENT DOCUMENTS 4,047,554 A * 9/1977 Bullat ..... 160/168.1 V
4,979,552 A * 12/1990 van der Zanden ..... 160/107
5,760,558 A * 6/1998 Popat ..... 318/480
6,112,798 A * 9/2000 Cheng ..... 160/174 V
6,474,393 B1 * 11/2002 Welfonder ..... 160/168.1 V

* cited by examiner

*Primary Examiner*—Blair M. Johnson
(74) *Attorney, Agent, or Firm*—Alan D. Kamrath; Nikolai & Mersereau, P.A.

(57) ABSTRACT

A Venetian blind includes a main body, a transmission mechanism, and a motorized drive mechanism. The motorized drive mechanism is operated to lift and lower the slats automatically. Thus, the Venetian blind does not need a lift cord, thereby preventing a child from being tangled by the lift cord so as to ensure the environmental safety of the house.

20 Claims, 8 Drawing Sheets

VENETIAN BLIND HAVING A MOTORIZED DRIVE MECHANISM

BACKGROUND OF THE INVENTION

1. Field of the Invention

The present invention relates to a Venetian blind and, more particularly, to a Venetian blind having a motorized drive mechanism to lift and lower the slats of the Venetian blind automatically without requiring manual work.

2. Description of the Related Art

A conventional Venetian blind comprises a headrail, a plurality of slats mounted on the headrail, a roller rotatably mounted in the headrail and connected to the slats for lifting and lowering the slats by rotation of the roller, a shaft tube secured on the roller for rotating the roller, a driven wheel secured on an end of the shaft tube for rotating the shaft tube, and an endless lift cord removably mounted on the driven wheel. In operation, the lift cord is pulled downward to rotate the driven wheel which rotates the shaft tube which rotates the roller so as to lift and lower the slats by rotation of the roller. However, the endless lift cord depending from the headrail can be reached by a child, so that the child is easily tangled by the endless lift cord, thereby causing danger to the child.

SUMMARY OF THE INVENTION

The primary objective of the present invention is to provide a Venetian blind having a motorized drive mechanism to lift and lower the slats of the Venetian blind automatically without requiring manual work.

Another objective of the present invention is to provide a Venetian blind, wherein the motorized drive mechanism is operated to lift and lower the slats automatically, so that the Venetian blind does not need a lift cord, thereby preventing a child from being tangled by the lift cord so as to ensure the environmental safety of the house.

A further objective of the present invention is to provide a Venetian blind, wherein the motorized drive mechanism can be controlled by a remote controller, thereby facilitating a user operating the Venetian blind to lift and lower the slats.

A further objective of the present invention is to provide a Venetian blind, wherein the Venetian blind is assembled easily and conveniently, thereby facilitating the user mounting the Venetian blind.

In accordance with the present invention, a Venetian blind is provided the includes a main body, a transmission mechanism, and a motorized drive mechanism, wherein:

the main body includes a headrail, a plurality of slats mounted on the headrail, and a roller rotatably mounted in the headrail and connected to the slats for lifting and lowering the slats by rotation of the roller;

the transmission mechanism is mounted on the main body and includes a shaft tube secured on the roller of the main body for rotating the roller of the main body, and a driven wheel secured on an end of the shaft tube for rotating the shaft tube; and the motorized drive mechanism is mounted on the main body and includes a motor, a drive wheel mounted on and rotated by the motor, and a driving member mounted between the drive wheel and the driven wheel of the transmission mechanism so that the driven wheel of the transmission mechanism is rotated by the drive wheel of the motorized drive mechanism.

Further benefits and advantages of the present invention will become apparent after a careful reading of the detailed description with appropriate reference to the accompanying drawings.

DETAILED DESCRIPTION OF THE INVENTION

Figure 1:
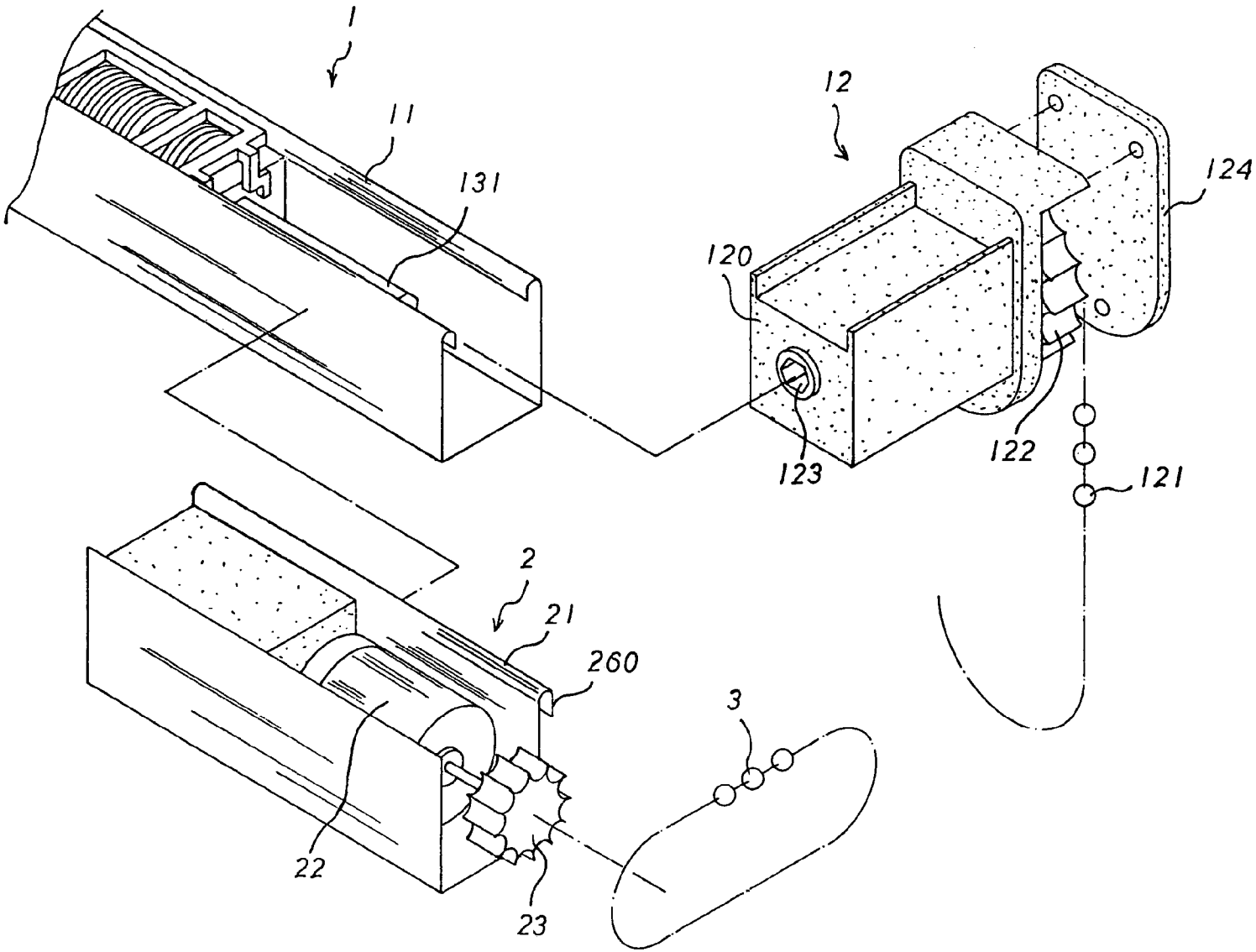
FIG. 1 is a partially exploded perspective view of a Venetian blind in accordance with the preferred embodiment of the present invention.
Figure 2:
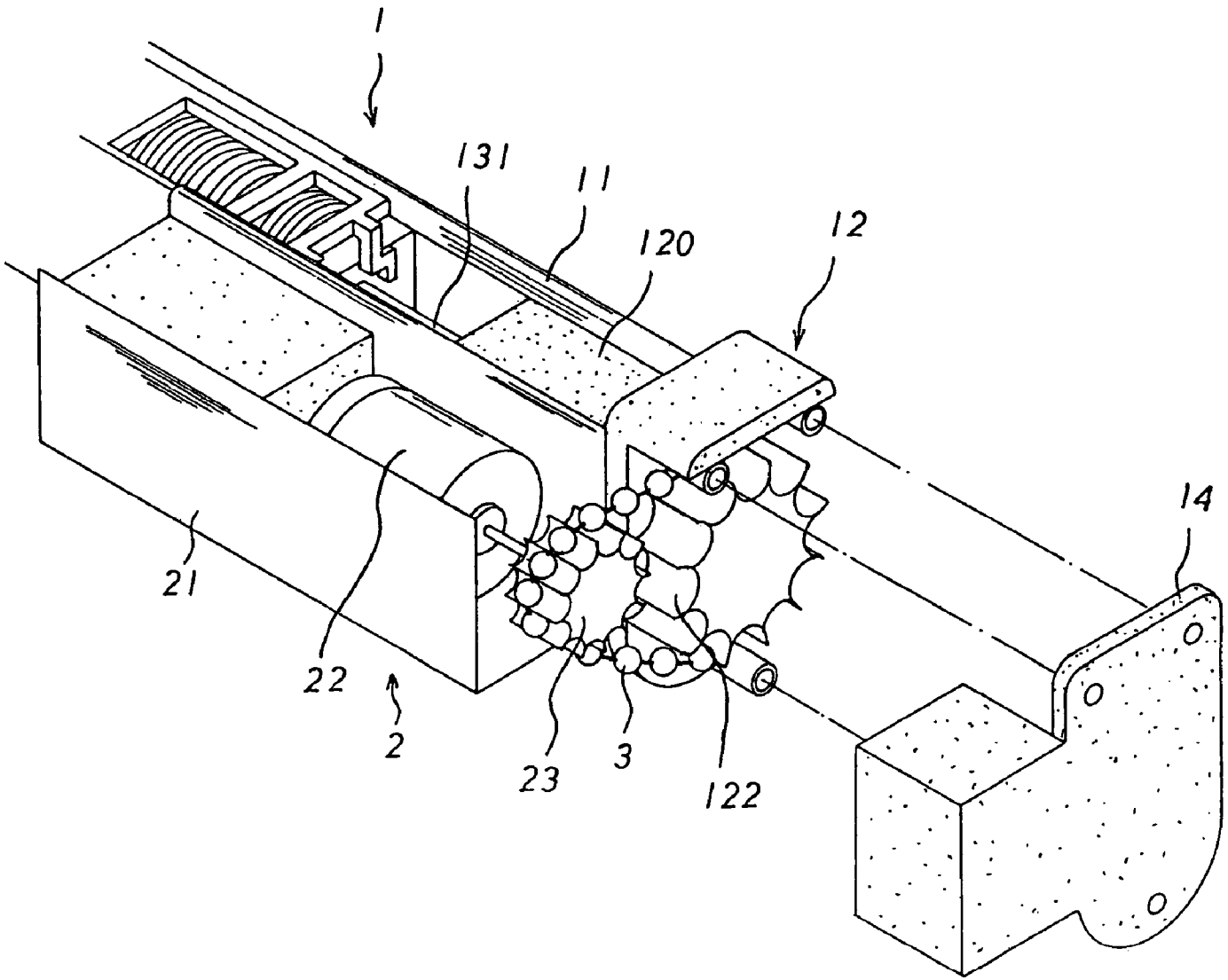
FIG. 2 is a partially exploded perspective assembly view of the Venetian blind in accordance with the preferred embodiment of the present invention.
Figure 3:
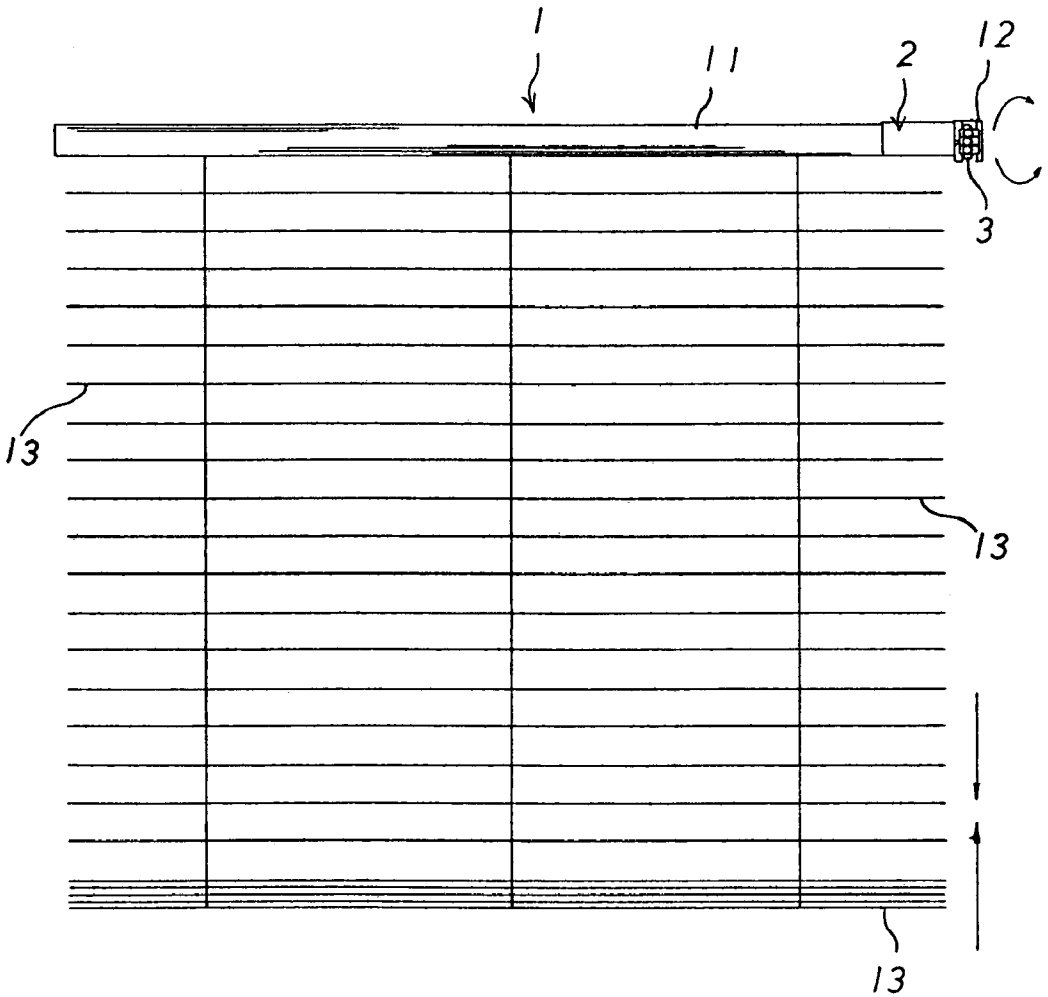
FIG. 3 is a front plan view of the Venetian blind in accordance with the preferred embodiment of the present invention.
Figure 4:
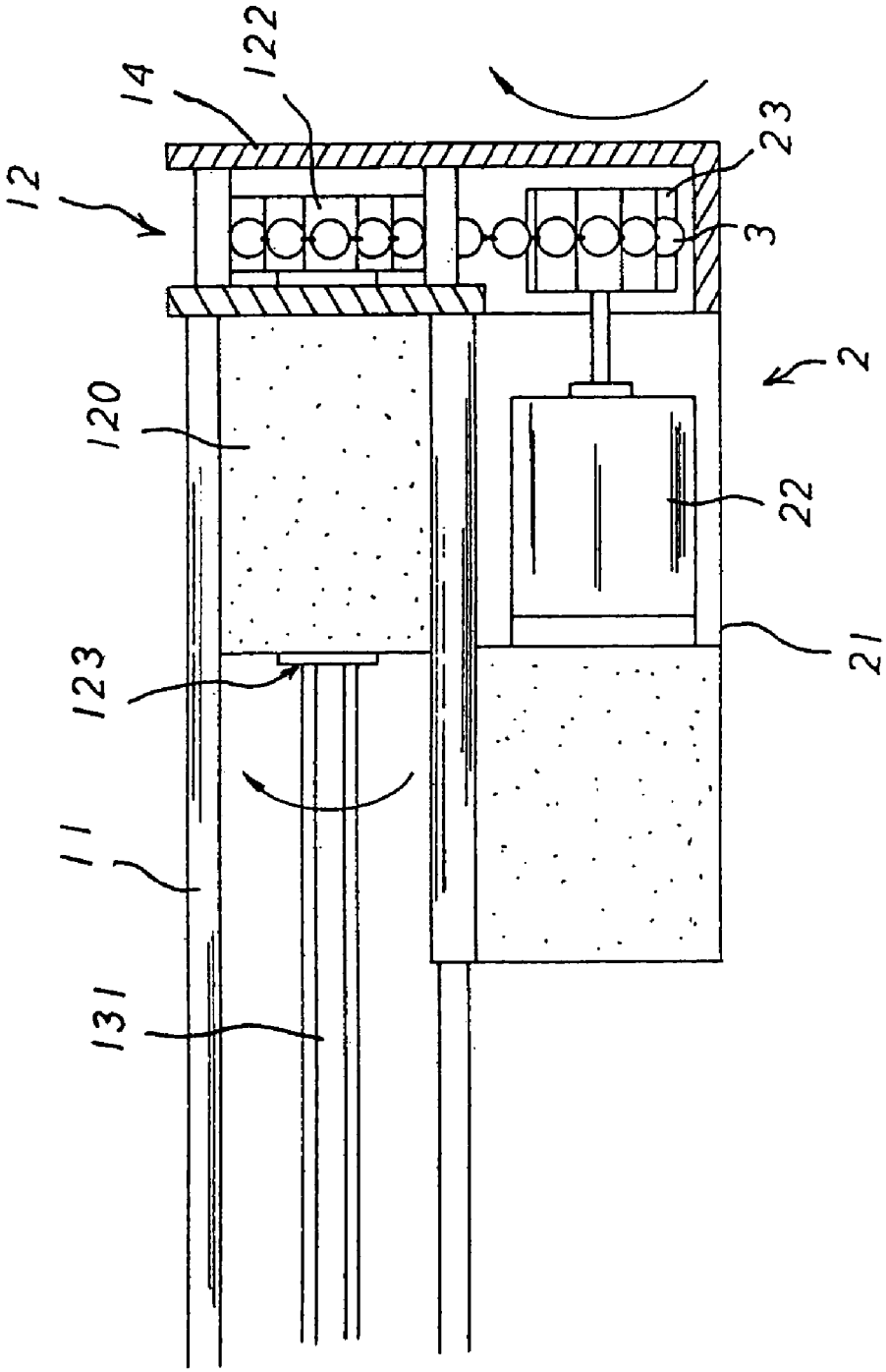
FIG. 4 is a partial, top plan cross-sectional assembly view of the Venetian blind as shown in FIG. 2.

Referring to the drawings and initially to FIGS. 1–4, a Venetian blind in accordance with the preferred embodiment of the present invention comprises a main body 1, a transmission mechanism 12, and a motorized drive mechanism 2.

The main body 1 includes a headrail 11, a plurality of slats 13 mounted on the headrail 11, and a roller 131 rotatably mounted in the headrail 11 and connected to the slats 13 for lifting and lowering the slats 13 by rotation of the roller 131.

The transmission mechanism 12 is mounted on the main body 1 and includes a support 120 mounted in the headrail 11 of the main body 1, a shaft tube 123 rotatably mounted in the support 120 and secured on the roller 131 of the main body 1 for rotating the roller 131 of the main body 1, and a driven wheel 122 secured on an end of the shaft tube 123 for rotating the shaft tube 123.

The motorized drive mechanism 2 is mounted on the main body 1 and includes an attachment bracket 21 mounted on a side of the headrail 11 of the main body 1, a motor 22 mounted in the attachment bracket 21, a drive wheel 23 mounted on and rotated by the motor 22, and a driving member 3 mounted between the drive wheel 23 and the driven wheel 122 of the transmission mechanism 12 so that the driven wheel 122 of the transmission mechanism 12 is rotated by the drive wheel 23 of the motorized drive mechanism 2. The attachment bracket 21 of the motorized drive mechanism 2 has a substantially U-shaped cross-section and has a side formed with a hook 210 hooked on the side of the headrail 11 of the main body 1. Preferably, each of the drive wheel 23 of the motorized drive mechanism 2 and the driven wheel 122 of the transmission mechanism 12 is a toothed wheel, and the driving member 3 of the motorized drive mechanism 2 is an endless cord having a plurality of balls meshing with the drive wheel 23 of the motorized drive mechanism 2 and the driven wheel 122 of the transmission mechanism 12.

In addition, the main body 1 further includes a cover 14 mounted on the transmission mechanism 12 and the motorized drive mechanism 2 to cover the drive wheel 23 of the motorized drive mechanism 2 and the driven wheel 122 of the transmission mechanism 12.

In addition, the transmission mechanism 12 further includes an endless lift cord 121 removably mounted on the driven wheel 122, and an outer cover 124 removably mounted on the support 120 to cover the driven wheel 122.

In practice, the outer cover 124 is removed from the support 120 to detach the lift cord 121 from the driven wheel 122. Then, the driving member 3 is mounted between the drive wheel 23 and the driven wheel 122 of the transmission mechanism 12, and the cover 14 is mounted on the transmission mechanism 12 and the motorized drive mechanism 2 to cover the drive wheel 23 of the motorized drive mechanism 2 and the driven wheel 122 of the transmission mechanism 12, thereby forming the Venetian blind.

In operation, the drive wheel 23 is rotated by the motor 22 to move the driving member 3 which rotates the driven wheel 122 which rotates the shaft tube 123 which rotates the roller 131 so as to lift and lower the slats 13 by rotation of the roller 131.

Accordingly, the motorized drive mechanism 2 is operated to lift and lower the slats 13 automatically, so that the Venetian blind does not need the lift cord 121, thereby preventing a child from being tangled by the lift cord 121 so as to ensure the environmental safety of the house. In addition, the motorized drive mechanism 2 can be controlled by a remote controller, thereby facilitating a user operating the Venetian blind to lift and lower the slats 13. Further, the Venetian blind is assembled easily and conveniently, thereby facilitating the user mounting the Venetian blind.

Figure 5:
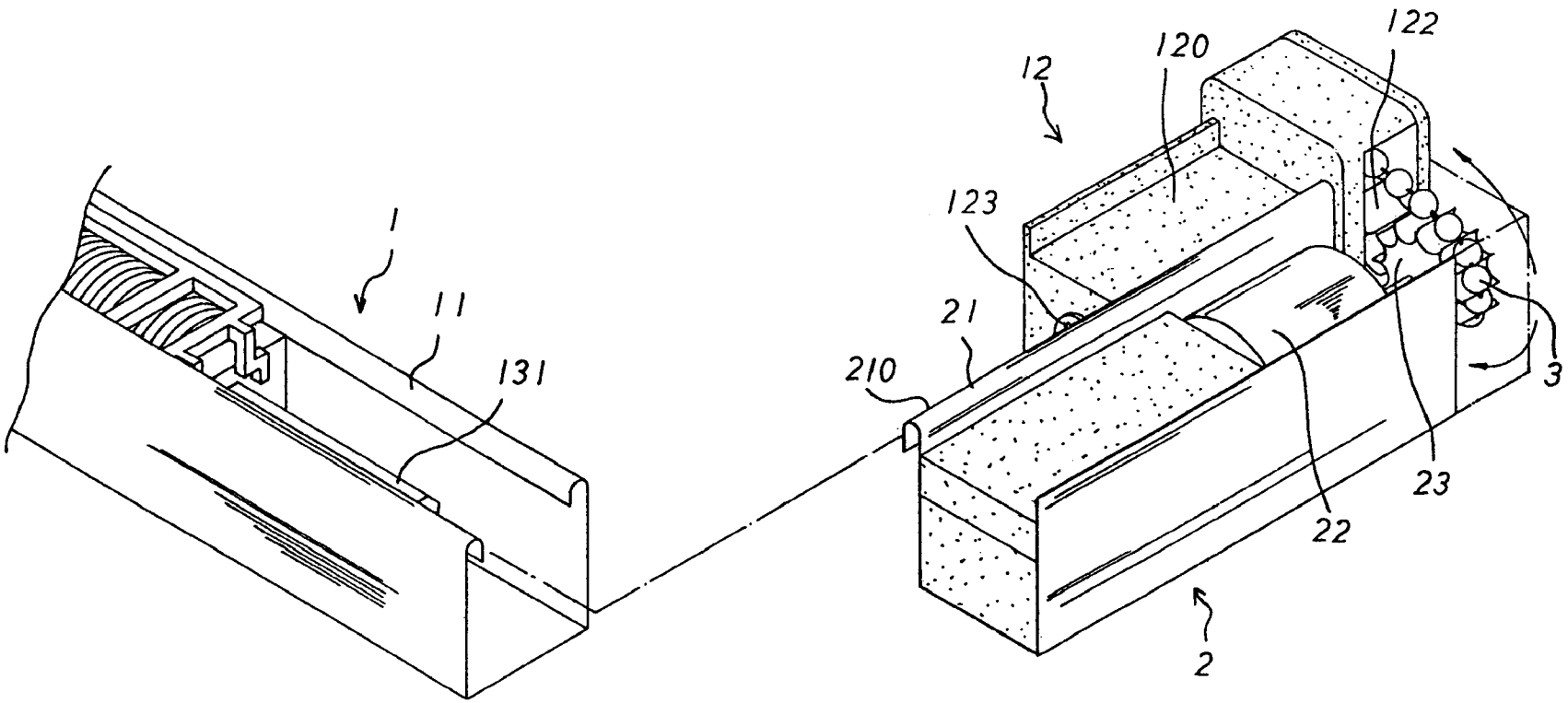
FIG. 5 is a partially exploded perspective view of a Venetian blind in accordance with another embodiment of the present invention.

Referring to FIG. 5 in another embodiment of the invention, the motorized drive mechanism 2 and the transmission mechanism 12 are integrally combined with each other, thereby facilitating the user mounting the Venetian blind.

Figure 6:
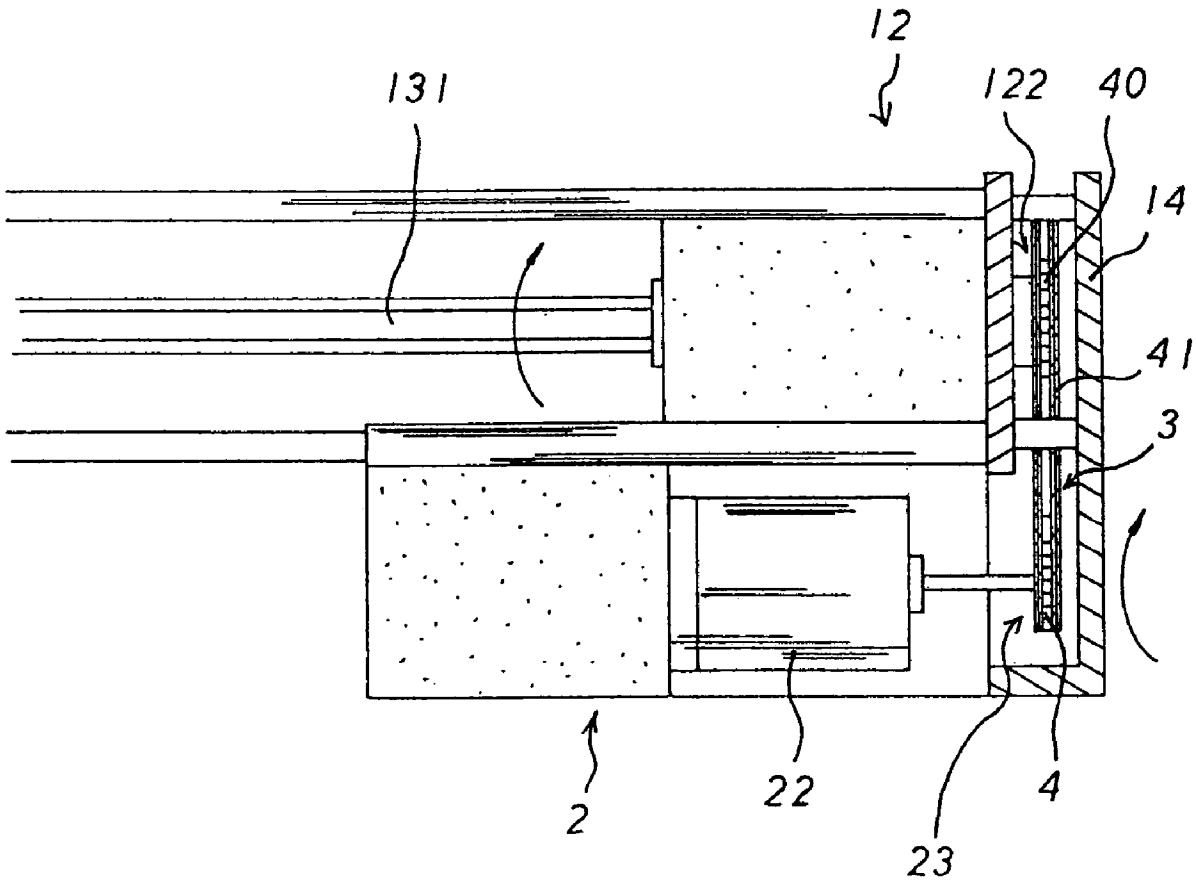
FIG. 6 is a partial, top plan cross-sectional assembly view of a Venetian blind in accordance with another embodiment of the present invention.

Referring to FIG. 6 in another embodiment of the invention, each of the drive wheel 23 of the motorized drive mechanism 2 and the driven wheel 122 of the transmission mechanism 12 is a sprocket 4 and 40, and the driving member 3 of the motorized drive mechanism 2 is an endless chain 41 mounted between and meshing with the sprockets 4 and 40 of the motorized drive mechanism 2 and the transmission mechanism 12.

Figure 7:
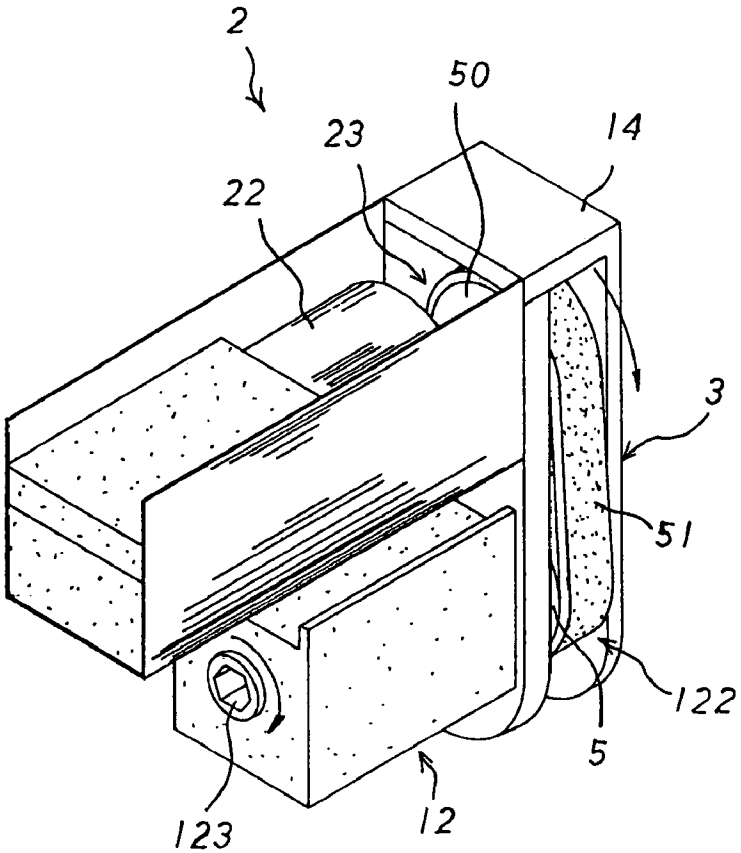
FIG. 7 is a perspective assembly view of a Venetian blind in accordance with another embodiment of the present invention.

Referring to FIG. 7 in another embodiment of the invention, each of the drive wheel 23 of the motorized drive mechanism 2 and the driven wheel 122 of the transmission mechanism 12 is a belt wheel 5 and 50, and the driving member 3 of the motorized drive mechanism 2 is an endless belt 51 mounted between and meshing with the belt wheels 5 and 50 of the motorized drive mechanism 2 and the transmission mechanism 12.

Figure 8:
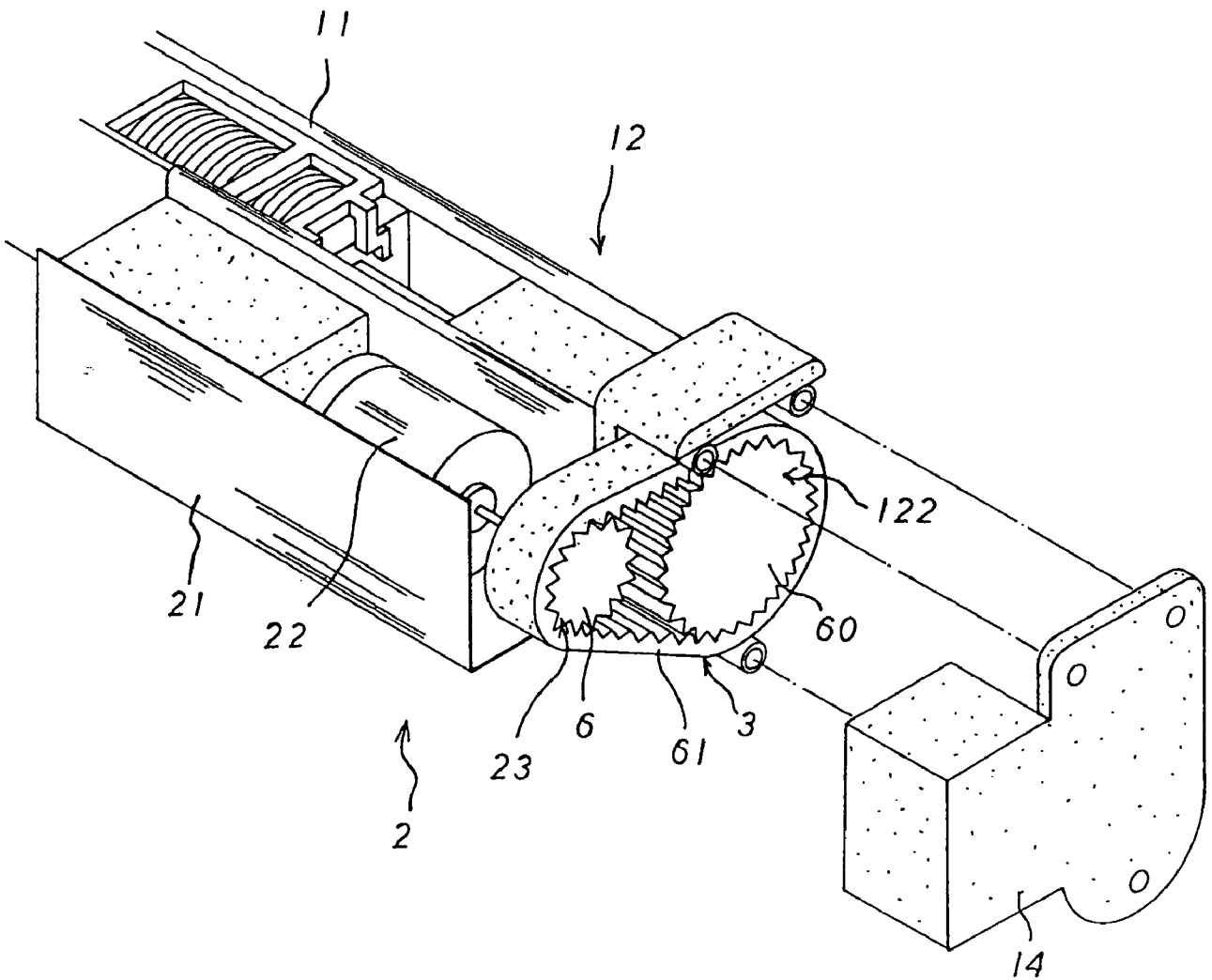
FIG. 8 is a partially exploded perspective view of a Venetian blind in accordance with another embodiment of the present invention.

Referring to FIG. 8 in another embodiment of the invention, each of the drive wheel 23 of the motorized drive mechanism 2 and the driven wheel 122 of the transmission mechanism 12 is a gear 6 and 60, and the driving member 3 of the motorized drive mechanism 2 is an endless toothed belt 61 mounted between and meshing with the gears 6 and 60 of the motorized drive mechanism 2 and the transmission mechanism 12.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A Venetian blind, comprising a main body, a transmission mechanism, a cover and a motorized drive mechanism, wherein:

the main body includes a headrail, a plurality of slats mounted on the headrail, and a roller rotatably mounted in the headrail and connected to the slats for lifting and lowering the slats by rotation of the roller, with the headrail having a substantially U-shaped cross-section including a first side, a second side, and a bottom extending between the first and second sides, with the headrail including an open end, with the roller located intermediate and parallel to the first and second sides;

the transmission mechanism is mounted on the main body and includes a support slideably mounted in the open end and between the first and second sides of the headrail of the main body, with a shaft tube rotatably mounted in the support and secured on the roller of the main body for rotating the roller of the main body, with a driven wheel secured on an end of the shaft tube for rotating the shaft tube and protruded outward from the support;

the motorized drive mechanism is attached to the first side of the headrail of the main body in parallel with the shaft tube of the transmission mechanism, with the motorized drive mechanism including an attachment bracket having a substantially U-shaped cross-section including a first side, a second side, and a bottom extending between the first and second sides, with the attachment bracket including an open end, with the motorized drive mechanism further including a motor mounted between the first and second sides of the attachment bracket, a drive wheel mounted on and rotated by the motor, and a driving member mounted between the drive wheel and the driven wheel of the transmission mechanism so that the driven wheel of the transmission mechanism is rotated by the drive wheel of the motorized drive mechanism, with the first side of the attachment bracket being removeably slideably attached and parallel to the first side of the headrail; and the cover is removably mounted to the support of the transmission mechanism and to the motorized drive mechanism and to cover the drive wheel, the driven wheel, and the driving member.

2. The Venetian blind in accordance with claim 1, wherein the first side of the attachment bracket of the motorized drive mechanism is formed with a downwardly extending hook hooked on the first side of the headrail of the main body.

3. The Venetian blind in accordance with claim 1, wherein each of the drive wheel of the motorized drive mechanism and the driven wheel of the transmission mechanism is a toothed wheel, and the driving member of the motorized drive mechanism is an endless cord having a plurality of balls meshing with the drive wheel of the motorized drive mechanism and the driven wheel of the transmission mechanism.

4. The Venetian blind in accordance with claim 1, wherein the transmission mechanism further includes an endless lift cord removably mounted on the driven wheel, and an outer cover removably mounted on the support to cover the driven wheel.

5. The Venetian blind in accordance with claim 1, wherein the motorized drive mechanism and the transmission mechanism are integrally combined with each other.

6. The Venetian blind in accordance with claim 1, wherein each of the drive wheel of the motorized drive mechanism and the driven wheel of the transmission mechanism is a sprocket, and the driving member of the motorized drive mechanism is an endless chain mounted between and meshing with the sprockets of the motorized drive mechanism and the transmission mechanism.

7. The Venetian blind in accordance with claim 1, wherein each of the drive wheel of the motorized drive mechanism and the driven wheel of the transmission mechanism is a belt wheel, and the driving member of the motorized drive mechanism is an endless belt mounted between and meshing with the belt wheels of the motorized drive mechanism and the transmission mechanism.

8. The Venetian blind in accordance with claim 1, wherein each of the drive wheel of the motorized drive mechanism and the driven wheel of the transmission mechanism is a gear, and the driving member of the motorized drive mechanism is an endless toothed belt mounted between and meshing with the gears of the motorized drive mechanism and the transmission mechanism.

9. The Venetian blind in accordance with claim 1, wherein the driven wheel of the transmission mechanism is protruded outward from the open end of the headrail.

10. The Venetian blind in accordance with claim 1, wherein the drive wheel is axially protruded outward from the open end of the attachment bracket.

11. The Venetian blind in according with claim 2, wherein each of the first and second sides of the headrail includes a hook extending downwardly inwardly towards the bottom, with the support slideably captured between the hooks of the first and second sides and the bottom of the headrail, with the downwardly extending hook of the attachment bracket received on the hook of the first side of the headrail.

12. The Venetian blind in accordance with claim 11, wherein the driven wheel of the transmission mechanism is protruded outward from the open end of the headrail.

13. The Venetian blind in accordance with claim 11, wherein the drive wheel is axially protruded outward from the open end of the attachment bracket.

14. A Venetian blind comprising a main body, a transmission mechanism, a cover and a motorized drive mechanism, wherein:

the main body includes a headrail, a plurality of slats mounted on the headrail, and a roller rotatably mounted in the headrail and connected to the slats for lifting and lowering the slats by rotation of the roller, with the headrail having a substantially U-shaped cross-section including a first side, a second side, and a bottom extending between the first and second sides, with the headrail including an open end, with the roller located intermediate and parallel to the first and second sides;

the transmission mechanism is mounted on the main body and includes a support slideably mounted in the open end and between the first and second sides of the headrail of the main body, with a shaft tube rotatably mounted in the support and secured on the roller of the main body for rotating the roller of the main body, with a driven wheel secured on an end of the shaft tube for rotating the shaft tube and protruded outward from the support;

the motorized drive mechanism is attached in parallel with the shaft tube of the transmission mechanism, with the motorized drive mechanism including an attachment bracket having a substantially U-shaped cross-section including a first side, a second side, and a bottom extending between the first and second sides, with the attachment bracket including an open end, with the motorized drive mechanism further including a motor mounted between the first and second sides of the attachment bracket, a drive wheel mounted on and rotated by the motor, and a driving member mounted between the drive wheel and the driven wheel of the transmission mechanism so that the driven wheel of the transmission mechanism is rotated by the drive wheel of the motorized drive mechanism, wherein the motorized drive mechanism and the transmission mechanism are integrally combined with each other; and the cover is mounted to the support of the transmission mechanism and to the motorized drive mechanism and to cover the drive wheel, the driven wheel, and the driving member.

15. The Venetian blind in accordance with claim 14, wherein each of the drive wheel of the motorized drive mechanism and the driven wheel of the transmission mechanism is a belt wheel, and the driving member of the motorized drive mechanism is an endless belt mounted between and meshing with the belt wheels of the motorized drive mechanism and the transmission mechanism.

16. The Venetian blind in accordance with claim 14, wherein each of the drive wheel of the motorized drive mechanism and the driven wheel of the transmission mechanism is a toothed wheel, and the driving member of the motorized drive mechanism is an endless cord having a plurality of balls meshing with the drive wheel of the motorized drive mechanism and the driven wheel of the transmission mechanism.

17. The Venetian blind of claim 14 with the roller being intermediate the bottom for the headrail and the bottom of the attachment bracket.

18. The Venetian blind in accordance with claim 17, wherein each of the drive wheel of the motorized drive mechanism and the driven wheel of the transmission mechanism is a belt wheel, and the driving member of the motorized drive mechanism is an endless belt mounted between and meshing with the belt wheels of the motorized drive mechanism and the transmission mechanism.

19. The Venetian blind in accordance with claim 14 with the first side of the attachment bracket abutting with the first side of the headrail.

20. The Venetian blind in accordance with claim 19, wherein each of the drive wheel of the motorized drive mechanism and the driven wheel of the transmission mechanism is a gear, and the driving member of the motorized drive mechanism is an endless toothed belt mounted between and meshing with the gears of the motorized drive mechanism and the transmission mechanism.

* * * * *